US006379162B1

(12) United States Patent
Raypole et al.

(10) Patent No.: US 6,379,162 B1
(45) Date of Patent: Apr. 30, 2002

(54) ELECTRICAL CONNECTOR SYSTEM

(75) Inventors: Steven Kent Raypole, Tipp City; Richard M. Fetcenko; Christopher Adrian Margrave, both of Cortland; Kathleen D. Murphy, Girard; Max F. Viney, Jr., Riverside; Christopher E. Schaefer, Warren, all of OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/626,987

(22) Filed: Jul. 27, 2000

(51) Int. Cl.[7] ..... H01R 4/66

(52) U.S. Cl. ..... 439/92; 439/347; 439/349; 188/282.2

(58) Field of Search ..... 439/92, 347, 349, 439/34, 484; 188/282.2, 299.1, 319.1; 267/220

(56) References Cited

U.S. PATENT DOCUMENTS 4,302,066 A * 11/1981 Newman et al. ..... 439/347
4,747,474 A * 5/1988 Kimura et al. ..... 188/282.2
5,022,865 A * 6/1991 Wright et al. ..... 439/279
5,454,585 A 10/1995 Dronen et al. ..... 280/660
5,639,255 A * 6/1997 Muzslay ..... 439/347
5,690,195 A 11/1997 Kruckemeyer et al. ..... 188/249
5,823,813 A * 10/1998 Dye ..... 439/347
6,007,345 A 12/1999 Francis et al. ..... 439/34
6,036,500 A 3/2000 Francis et al. ..... 439/34

* cited by examiner

*Primary Examiner*—P. Austin Bradley
*Assistant Examiner*—Ross Gushi
(74) *Attorney, Agent, or Firm*—Scott A. McBain

(57) ABSTRACT

A suspension damper system is provided. The damper system includes a damper with a damper rod, a portion of which extends from the proximal end of the damper. The damper rod includes a bore and an electrode disposed within the bore. A fastener for securing the damper rod to a vehicle is also provided. The fastener is disposed over the damper rod and includes a circumferential groove. An electrical connector which includes an electrically conducting terminal is connected to the electrode. The connector includes a lock which mates with the groove in the fastener and includes a ground terminal which is connected to the damper rod.

21 Claims, 5 Drawing Sheets

ELECTRICAL CONNECTOR SYSTEM

The present invention relates to an improvement in the electrical connection system generally used in low profile applications and more particularly to an electrical connector to mechanical interface locking and connection system.

INCORPORATION BY REFERENCE

Dronen, et al U.S. Pat. No. 5,454,585 and Kruckmeyer et. al. U.S. Pat. No. 5,690,195 are incorporated by reference herein so that certain details of damper and strut assemblies need not be described in detail herein.

BACKGROUND OF THE INVENTION

Dampening components used in vehicle shock absorbing systems, including shocks, struts or engine mounts have dampening characteristics which can be varied to adjust the dampening component to desired conditions. Dampers are well known in the prior art. Examples can be seen in Dronen et al U.S. Pat. No. 5,454,585 and Kruckemeyer et al U.S. Pat. No. 5,690,195 (incorporated by reference herein). The dampening characteristics may be varied to account for a number of different factors. These include speed, cornering status of the vehicle, weight distribution etc. Such dampers generally contain adjustable valving, solenoid or other electrically actuable devices.

A relatively new type of adjustable damper is also available. These dampers, magnetorheological fluid dampers, also known as MR dampers, damp shock forces sustained by a vehicle by transmitting the forces to a piston or diaphragm etc. which is pushed through a chamber filled with magnetorheological fluid. An electrical coil adjoins the chamber where the MR fluid is provided. Electric current flowing in the coil varies the properties of the magnetorheological fluid pumped by the piston through an orifice in or adjacent the piston. In this manner, the flow of magnetorheological fluid and thus the amount of dampening, can be controlled.

Generally, the piston that is pushed through the magnetorheological fluid is mounted on the end of a rod within the damper. Electric current is provided to the coil electrically adjustable valving or solenoid from the end of the rod opposite the piston by means of an electrical conductor in the rod. The conductor is electrically coupled to a connector by a coupling assembly mounted at the end of the damper. Generally, the end of the rod protrudes through the damper and receives an electrical connection or plug that delivers power, ground and/or a signal from a vehicle electrical system. When damping characteristics with the damper need to be altered (such as when sensors on a vehicle detect certain preset specified factors such as changes in speed, cornering, etc.) an electrical signal can be sent to the coil, solenoid or adjustable valving in the damper via the electrical coupling assembly.

Dampers, including shocks, struts, and engine mounts and struts may be exposed to water or other contaminants depending on location and orientation of the damper within a vehicle. For instance, certain automotive struts are installed with a piston at the bottom portion of a piston rod, damper rod and located at the bottom portion of the vehicle. The opposite end of the rod then projects through a shock tower opening into the vehicle engine compartment. In other applications, such as to relieve side loads to damper rods, the orientation of the strut is reversed so that the electrical conductor exits the bottom of the rod in an "upside-down" position. In such an orientation in a vehicle suspension, the plug or coupling assembly may be fully exposed to moisture dirt or other contaminants not as prevalent in the engine compartment. Such orientation may also find the damper subject to greater physical shocks, including the higher frequencies and amplitudes found at the vehicle wheel rather than those found within the vehicle body.

Particularly in shock and strut construction, the length of the strut is a large factor in its placement within a vehicle. Thus, any reduction in the overall length of the strut system is an advantage. Heretofore, electrical connections have added significantly to the overall length of the damper. Examples of electrical connections in the prior art can be seen in Frances et. al. U.S. Pat. No. 6,007,345 and Frances et. al. U.S. Pat. No. 6,036,500. The '500 patent shows an electrical connection system to a strut involves placing a large connector on the top of a shock or strut tenon. The connector is placed on the tenon and thereafter an operator locks the connector by twisting a lock ring. The lock ring causes two metal legs to squeeze onto the tenon threads and secure the connector to the shock. However, there is no obvious method to assure that the connector is fully seated. Thus there is no way to ensure that connector has actually made electrical contact with the electrode.

Another electrical connection can be found on what is referred to as a Computer Command Ride (CCR) shock. The CCR shock developed a lip around the very tip of the damper rod that enabled a connector to lock in place. However, the CCR rod is a very large diameter rod which is detrimental to the design since it requires a large diameter piston that affects the overall shock package size, which in turn requires a very large connector body. The design also prohibits the mating of the ground circuit to the outside diameter of the damper rod, which is needed to provide a connection system that does not require rotational alignment before mating. This solution is impractical for most shocks or struts in which the diameter of the rod is small or where space considerations need to be taken into account. Thus, alternatives to the CCR shock connection are necessary.

The known prior art also requires an operator to install an electrical connector using two hands. Therefore, engine compartment design requires a design in which hand clearance for installation must exist. For example, such clearance requirements must be available to twist the lock shown in the '500 patent. Furthermore, service and maintenance considerations must also be considered. Existing designs do not provide an obvious way to disconnect the electrical connection to service personnel. This can result in frustration or damage to the connector during servicing.

Other methods of attaching a connector directly to a damper rod could potentially degrade the tensile and torsional integrity of the piston rod valve.

SUMMARY OF THE INVENTION

Accordingly, it is a feature of the present invention to provide an improved suspension damper which overcomes the disadvantages of prior art suspension dampers by providing a unique interface system which allows both connection of the damper to the vehicle and connection of an electrical connector to the damper in a simplified connection system. The invention can be used with any ride control system that requires power and /or an electric signal to reach the core of a damper including a shock absorber, strut or engine mount.

As used herein, "damper" and suspension damper refer generically to any device used to dampen vehicle vibration, including the aforementioned shocks, struts and engine mounts. The terms shocks, struts and mounts are used interchangeably throughout, but all refer to suspension dampers. The present invention provides a connection to the damper rod/piston rod (also referred to as a shock rod or tenon) provides both signal and ground circuits, has a minimal size, a low insertion force, non-orientation problems, and a retaining system which ensures the electrical connector is retained on the damper during vehicle usage.

The new connector utilizes a fastener (specifically a tenon nut) that is currently being used to secure the damper to the vehicle. The nut is first modified by adding a groove below an end portion of the existing tenon nut. In a preferred embodiment, a chamfer is also added. The connector can be both mated and locked to the tenon nut at any rotational angle in a smooth operation by an assembler using one hand. Since the tenon nut must already be installed to retain the damper (shock or strut) to the vehicle, no new labor operations are required. The modification to the tenon nut provides a groove that accepts a wire clip that is preferably made part of the electrical connector. Mechanical attachment of the connector to the damper strut assembly is achieved by pushing the connector downward onto the modified tenon nut that is also used to secure the damper to the vehicle. As the connector reaches its fully seated position the wire lock (which is preferably integral to the connector) grips the groove of the tenon nut and is secured.

The preferred embodiment also includes a connector position assurance (CPA) member. This portion of the electrical connector is snapped into place to prevent the wire lock from being disengaged accidentally or through vehicle vibration. The wire lock and the CPA provide a positive visual indication that the connector is secure to the damper. The CPA and wire lock can be subsequently disengaged for easy serviceablity to remove the connector from the damper. In addition to the connection system being serviceable, it also provides a positive visual indication that the connector is secure to the damper.

In a preferred embodiment, the tenon nut is an internally threaded coupling nut which resembles a standard nut on the lower external half and has a low angle ramp on the exterior upper end is rotated downward onto a threaded rod of the damper. An exterior annular locking groove is disposed between a low angle ramp (or chamfered) portion and the nut (or tool engaging) portion. The locking groove accepts a wire clip that is part of the electrical connector body and locks these two devices together. The preferred embodiment electrical connection allows power and ground circuits to be electrically connected and secured to the damper assembly. The two opposite ends of the connector are formed at about a 90° angle from one another to further allow the connection system to be used in areas with space restrictions. In this embodiment electrical current is delivered to a pin which is isolated from and runs through the center of the damper rod. A ground terminal mates with the damper rod, which is used to complete the electrical path. The system also provides an environmental seal for the electrical interfaces.

These features along with other features, of the present invention are achieved in a suspension damper comprising a longitudinally extending cylinder portion, the cylinder portion including both proximal and distal ends. The damper rod, carried in the damper, extends from the proximal end of the damper. The damper rod includes a bore with an electrode disposed within that bore. A fastener for securing the damper rod to a vehicle is also provided. The fastener is disposed over the damper rod and includes a groove. An electrical connector for supplying electrical power to the electrode is provided and includes a power terminal having at least a first and a second end. The first end is connected to the electrode and the connector is secured to the fastener with a lock which mates with the groove of the fastener. In the preferred embodiment, the perimeter of the nut includes both a tool engaging portion, which resembles a common nut and accepts a tool for rotation, a chamfered portion and a grooved portion therebetween. The lock, in a preferred embodiment comprises a spring wire, which slides over the chamfered portion and is captured within the groove. A position assurance member is removably attached to the electrical connector and the spring wire assuring that the spring wire cannot be disengaged from the damper. It also provides positive visual assurance that the connector is seated properly.

In accordance with another aspect of the invention an electrical connection system is provided which comprises a fastener for securing a damper to a vehicle, the fastener including a groove therein. An electrical connector which includes a power terminal having at least a first and second end for supplying electrical power to the damper is provided. The connector includes a lock which mates with the groove of the fastener. In accordance with a more specific feature of the invention, the lock is a spring lock which includes two legs extending therefrom which cooperate with at least one tab on the electrical connector to open and close the lock. The connection system includes a position assurance member removeably attached to the electrical connector of the spring lock. The position assurance member includes an arm which entraps the spring lock and prevents transverse movement thereof.

In another aspect of the invention an electrical connector body is provided which includes a housing that has at least a first longitudinally extending portion and a second portion extending orthogonal thereto. A conductive ring is located within the first portion and a first power conducting terminal is generally located within the second portion. The first power conducting terminal is releaseably attached to the conductive ring. In a preferred embodiment the conductive ring includes a spring arm which releaseably attaches to the first power terminal, a portion of the first power terminal being molded within the housing.

Yet another aspect of the invention includes an electrical connector body comprising a housing including a first end portion and a second end portion. A first power terminal generally extends between the first end portion and a ground terminal located within an interior cavity of the second end portion. A second power terminal generally extends between the first and second end portions. An environmental barrier including a connector seal is disposed within the interior cavity of the second end portion. A vibration dampener is provided integral with the connector seal. In a preferred embodiment the vibration dampener includes a plurality of legs extending outwardly from the second end portion that come to rest on the top of the fastener when assembled.

Thus, it is a principal object of the present invention to provide an improved suspension damper system which can be easily installed within a vehicle.

Yet, it is another object of the present invention to provide an improved suspension damper system which has a compact design thus requiring less clearance space within a vehicle than prior art designs.

Still yet another object of the present invention is to provide an improved suspension damper connector which provides positive visual assurance that an electrical connection is in place.

Yet, another object of the invention is to provide an improved electrical connection system to reduce the complexity of installation and reduce overall costs.

These and other objects of the invention will become apparent to those skilled in the art upon reading and understanding the following detailed description of preferred embodiments.

BRIEF DESCRIPTION OF THE DRAWINGS

The invention may take physical form in certain parts and arrangement of parts, preferred embodiments of which will be described in detail and illustrated in the accompanying drawings which form a part hereof and wherein.

DETAILED DESCRIPTION OF THE INVENTION

Figure 1:
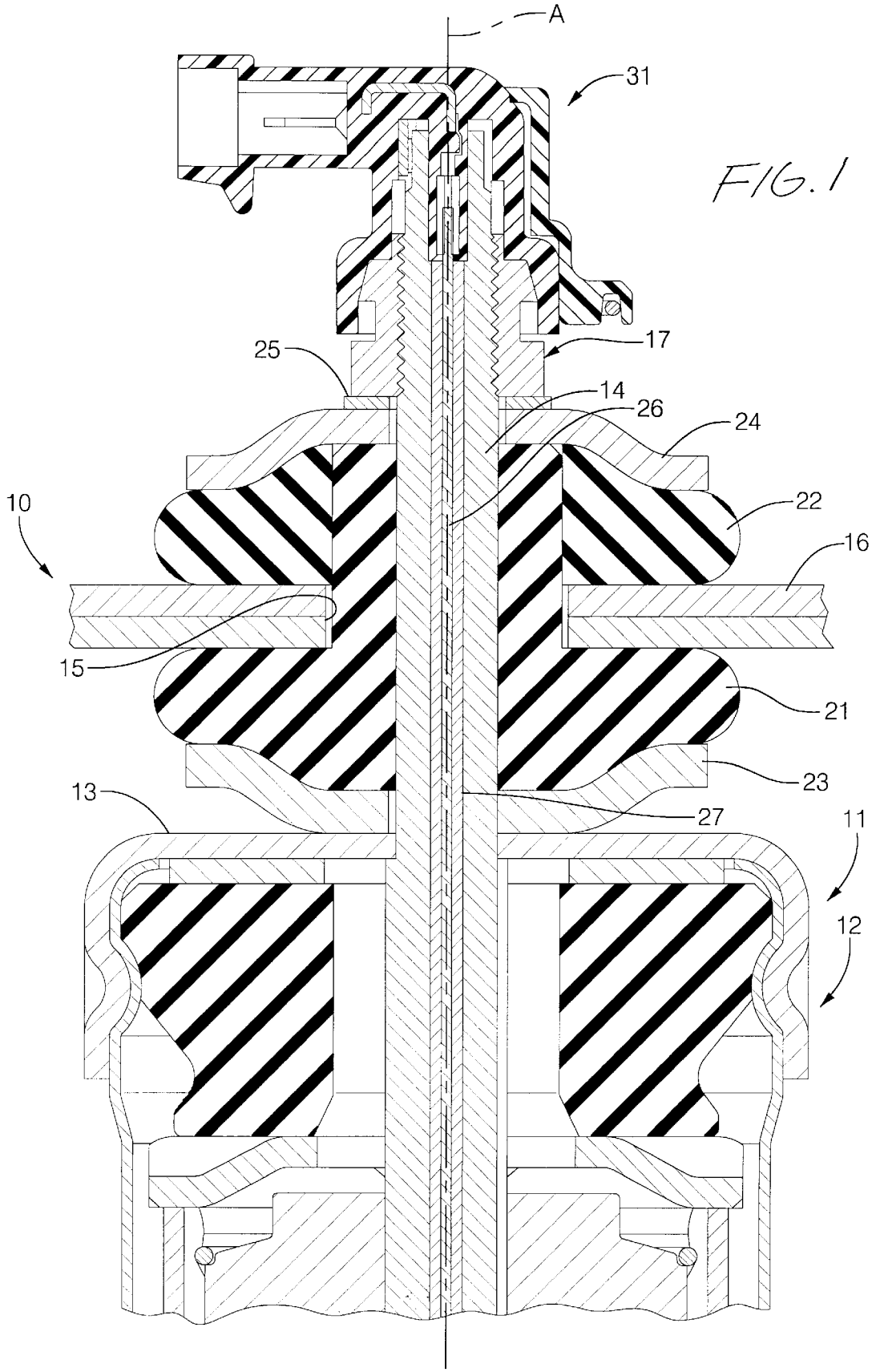
FIG. 1 is an elevation view, partially in section, showing a suspension damper of the present invention.

Referring to the drawings, wherein the showings are for the purpose of illustrating the preferred embodiment of the invention only and not for the purpose of limiting same, FIG. 1 shows a suspension damper system 10 which includes a damper in the form of a strut 12 and comprises a cylinder portion 11 of strut 12 longitudinally extending about longitudinal axis A. Extending along longitudinal axis A from a proximal end 13 through strut 12 is a damper or piston rod 14. Piston rod 14 extends through an annular opening 15 in the frame of the vehicle 16 and is retained therein by a fastener 17. Extending through annular opening 15 is a rubber bushing 21 and a complementary rubber bushing 22 sandwiched between first and second portions of a rate cup 23 and 24. A washer 25 is also interposed between second rate cup portion 24 and fastener 17. Piston rod 14 carries an electrode pin 26 surrounded by an insulating sheath 27. Pin 26 has a preferred diameter of about 1.00 millimeter and serves to electrically connect an electrically actuable member (not shown) within strut 12 to adjust the ride characteristics of strut 12. Piston rod 14 is comprised of an electrically conductible material which services as a ground path for an electrical connector 31 to the electrically actuable member (not shown). The electrically actuable member located within strut 12 is controlled by an electrically adjustable valve, solenoid or coil to charge magnetorheological fluid, each of which acts to prevent (or allow) movement of a piston with strut 12. It will be appreciated that such a damper or strut assembly is well known in the art. As such, particular strut assemblies will not be described in detail. The present invention can be used with any number of damper assemblies requiring electrical connection thereto.

Electrical connector 31 is overmolded onto two power or electrically conducting terminals, sonically welded terminal assembly 32 which provides power and a male ground terminal 33. Electrical connector body 31 is molded at a 90° angle to reduce the overall height. This makes it ideal for limited clearance applications of the present invention. The housing of electrical connector 31 includes a first longitudinally extending portion 34 and a second orthogonally extending portion 35 that are joined together by a third elbow portion 36. Longitudinally extending portion 34 includes an interior cavity 37, defined by an interior surface wall 41, which connects to piston rod 14. Orthogonally extending portion 35 includes an interior portion 42 which mates with a harness connector assembly 43, which is connected to a vehicle electrical system. Harness connector assembly 43 is attached to electrical connector 31 in a conventional manner.

Figure 4A:
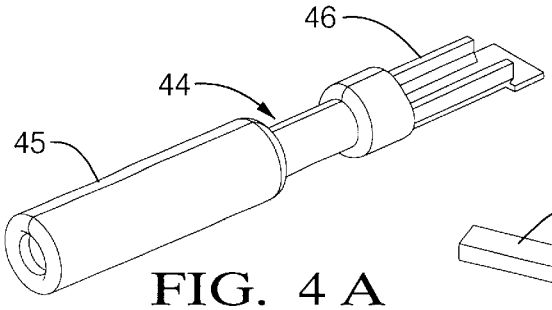
FIGS. 4A, 4B, and 4C are exploded views of another aspect of the present invention.
Figure 4B:
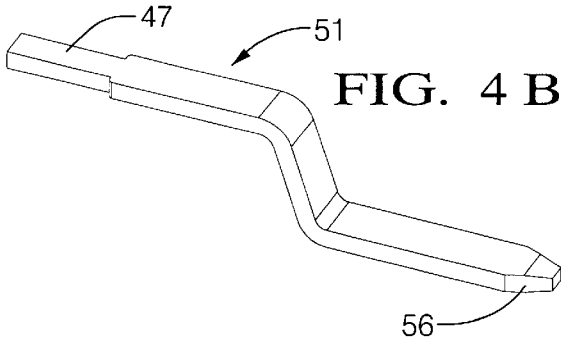
Figure 4C:
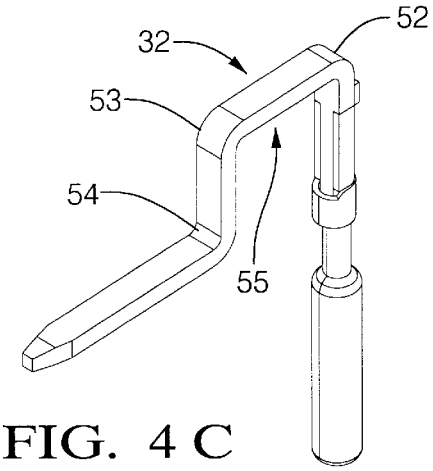
Figure 6:
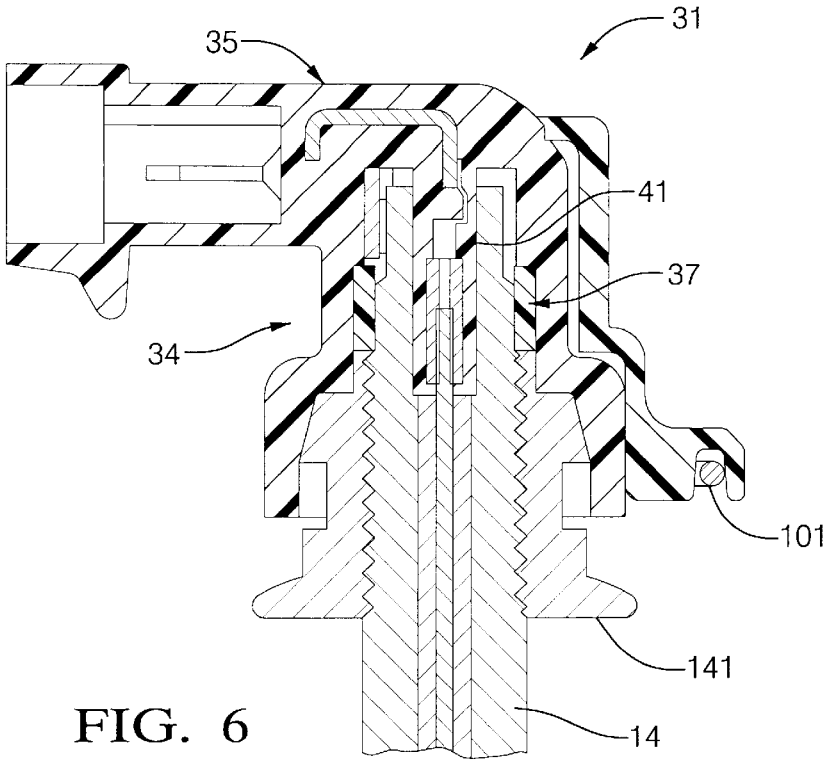
FIG. 6 is an elevation view, partially in section, of a modified embodiment of an electrical connection of the present invention.
Figure 8:
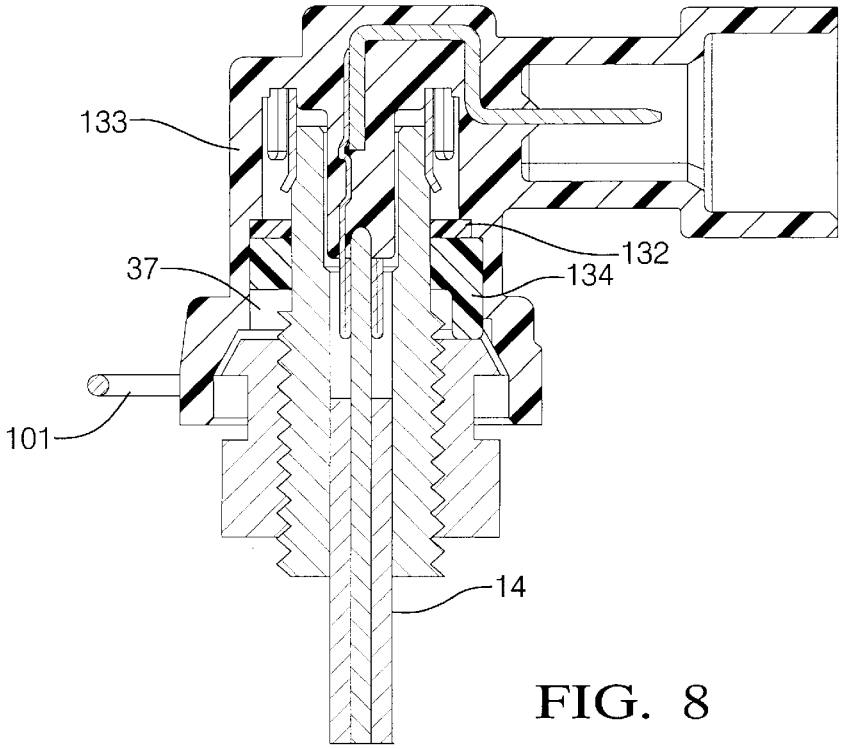
FIG. 8 is a cross-sectional elevation view showing the electrical connection of the present invention, in a partially assembled state.
Figure 7:
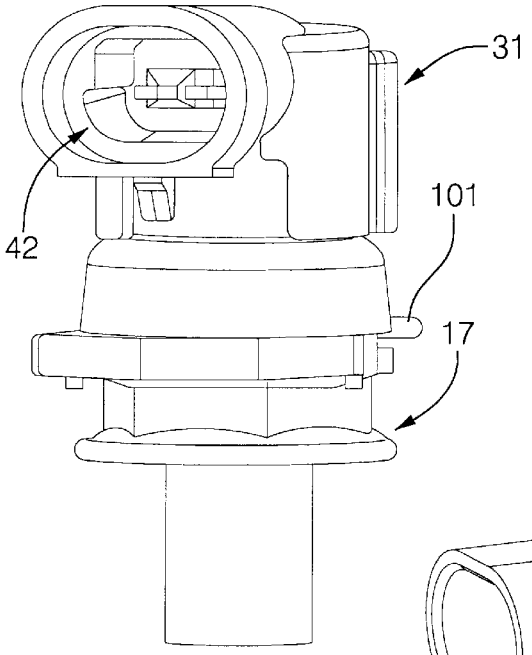
FIG. 7 is a pictorial view of an assembled electrical connection of the present invention.

Sonically welded terminal assembly 32 is best seen in FIGS. 4A through 4C. A barrel power terminal 44 is seen in FIG. 4A. Power terminal 44 includes a female barrel end 45 and a wire insulation end 46. The insulation end 46 of the barrel power terminal 44 is sonically welded to an unplated end 47 of a male blade 51. Insulation end 46 is then crimped to prevent plastic from flowing into the barrel during molding. In the assembled state, shown in FIG. 4C, terminal assembly 32 has three generally 90° bends, a first bend 52 is needed after assembly and provides right angle access to interior cavity 37 of connector 31 and ultimately to the electrode pin. A second bend 53 and a third bend 54 allow overmolding within electrical connector 31. As seen in FIG. 4C the bends 52, 53, 54 form a u-shape portion 55, which is overmolded with plastic, at elbow portion 36 of connector 31. As seen in FIGS. 6 and 8, portions of barrel power terminal 44 are also molded in plastic to provide electrical isolation from piston rod 14 while centering barrel end 45 to mate with electrode pin 26 in piston rod 14. A plated end 56 of male blade 51 mates to a female end 57 of harness connector assembly 43 on the chassis harness in a conventional manner. Thus, power is provided to strut 12 by electrical connector 31.

Figure 3:
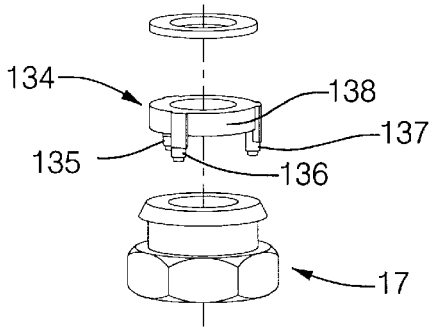
FIG. 3 is an exploded view showing one aspect of the present invention.
Figure 3:
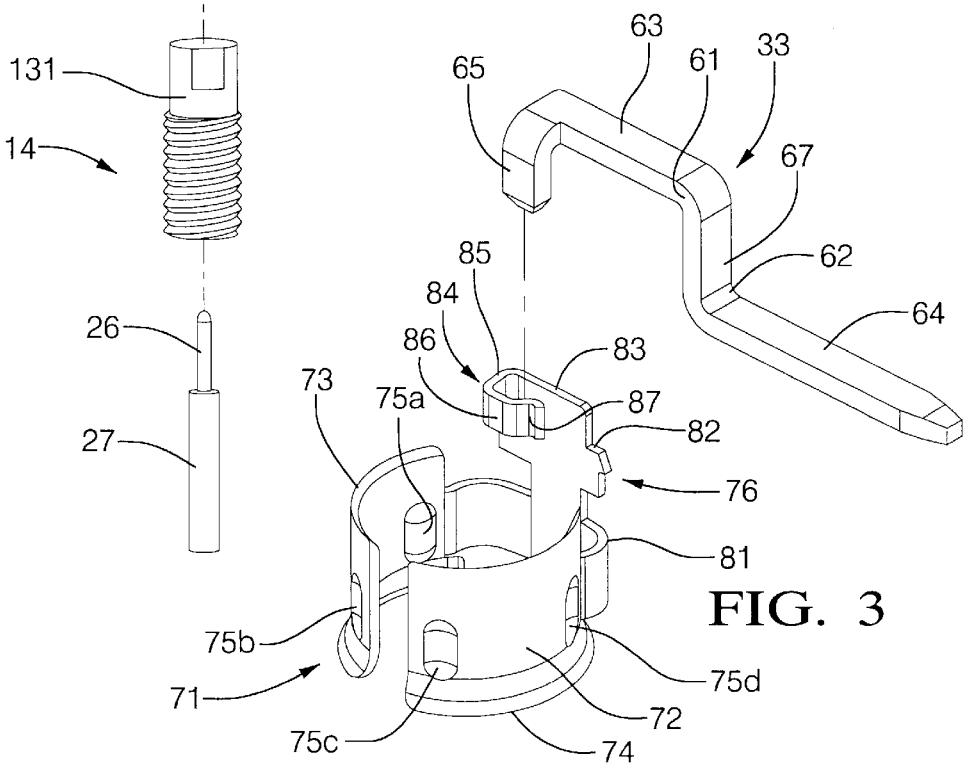

Male ground terminal 33 has two 90° bends, a first bend 61 and a second bend 62, as seen in FIG. 3. Bends 61, 62 separate ground terminal 33 into a mold portion 63 and a connection portion 64. A small tab 65 extends from mold portion 63 and is generally parallel to an arm 67 which extends between bends 61 and 62. Similar to terminal assembly 32, ground terminal 33 and specifically first bend 61, mold portion 63 and arm 67 are molded within elbow portion 36 of connector 31. As seen in FIG. 3, tab 65 extends from mold portion 63 both longitudinally and radially inwardly toward axis A. Tab 65 is not covered by plastic in the elbow portion 36. Instead tab 65 extends longitudinally into interior cavity 37 of connector 31 where it makes contact with a ground ring 71, also shown in FIG. 3.

Ground ring 71 is "C" shaped and generally has a diameter equal to that of the interior surface wall 41, of interior cavity 37, in order that it may snugly fit therein. A circumferential surface 72 is bounded by an upper perimeter end 73 and a lower perimeter end 74 which is flared radially outwardly to provide a lead in for piston center rod 14 during the connection process. As shown in FIG. 3, four protrusions 75*a* through 75*d* extend radially inwardly from circumferential surface 72 and provide a sufficient radial force between the exterior of piston rod 14 and interior ground ring 71 to maintain electrical contact therebetween.

Ground ring 71 includes a terminal attachment portion 76. Terminal attachment portion 76 includes an arc portion 81 extending between first and second portions of circumferential surface 72, and an extension arm 82 which extends longitudinally and generally tangential to arc portion 81 and circumferential surface 72. Adjacent an upper end 83 of terminal attachment portion 76 is a spring arm 84. Spring arm 84 is also of a "C" shape and includes a radially extending inward portion 85, a tangential portion 86 which is opposite and generally parallel to extension arm 82 and a detent portion 87. Tab 65 of male ground terminal 33 fits into spring arm 84 and is retained securely therein by detent portion 87. The "C" shaped spring arm 84 is a substantial improvement over the prior art in that it allows the ground terminal to be easily molded within an electrical connector. The ground ring can then be snapped into place in one simple step by aligning spring arm 84 with tab 65. Advantageously no tools are needed. Thus, connection portion 64 of terminal 33 may be connected to harness assembly 43 to complete a ground circuit.

Figure 5A:
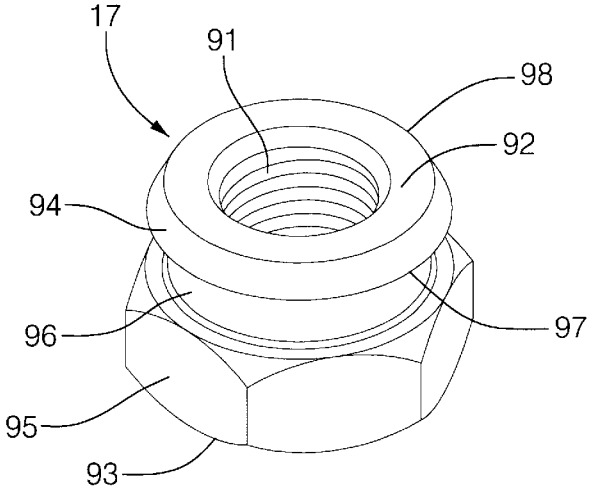
FIGS. 5A and 5B are detailed pictorial views of yet another aspect of the present invention.
Figure 5B:
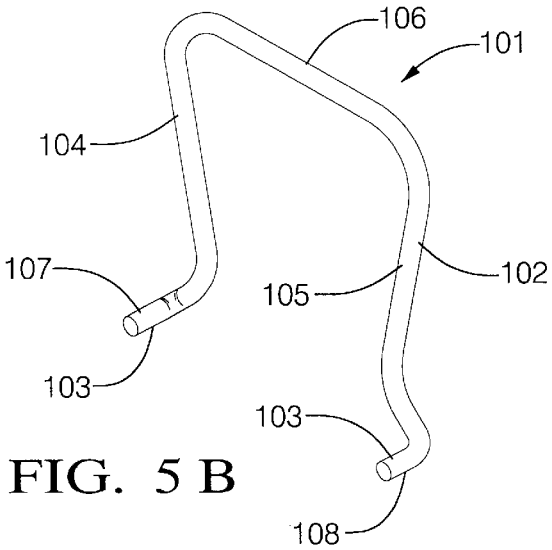

As seen in FIG. 5A, fastener nut 17 serves a two-fold purpose. It secures an end of strut 12 to the vehicle as shown in FIG. 1 and in accordance with the present invention secures electrical connector 31 to piston rod 14. Fastener nut 17 includes an interior threaded portion 91 extending between first and second ends 92 and 93. The exterior of the nut includes three distinctive portions, a chamfered or ramped portion 94 which extends radially outwardly from first end 92, a tool engaging portion 95 which is for engaging with a standard socket to torque fastener 17 into place. Tool engaging portion 95 is comprised of six sides, like a standard hex nut. However, it will be appreciated that any common fastener orientation may be used. Extending longitudinally between chamfered portion 94 and tool engaging portion 95 is a grooved portion 96. Grooved portion 96 has a diameter less than tool engaging portion 95 and less than an outer radial perimeter 97 of chamfered portion 94. Preferably, the diameter of groove portion 96 is also less than the diameter of an inner radial perimeter 98 of chamfered portion 94. Groove portion 96 allows fastener 17 to capture a wire lock 101, seen in FIG. 5B, which is part of connector 31.

Figure 10:
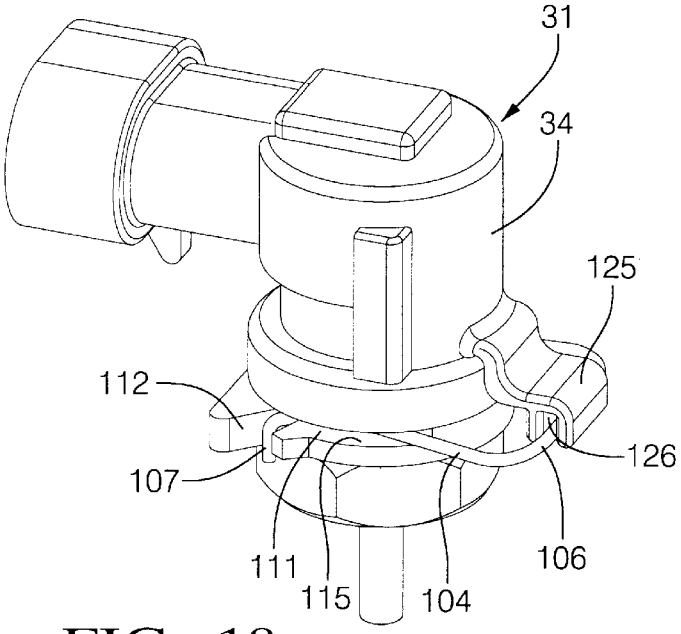
FIG. 10 is a pictorial view showing a fully assembled electrical connection of the present invention.

Wire lock 101 is a spring wire that includes a transverse plane portion 102 which, when in place as shown in FIG. 10, is located in a plane generally transverse to longitudinal axis A of fastener 17. A longitudinal plane portion 103 is located in a place generally parallel to longitudinal axis A. Transverse plane portion 102 includes a loop of spring wire having two opposite fingers 104 and 105 which are connected by a bridge finger 106 to form the loop shape. Fingers 104 and 105 extend inwardly from bridge finger 106 in order that they form an acute angle to each other. A leg 107 and 108 lying in longitudinal plane portion 103 extend at a generally 90° angle from fingers 104 and 105, respectively. Legs 107 and 108 prevent wire lock 101 from separating from connector 31.

Figure 2:
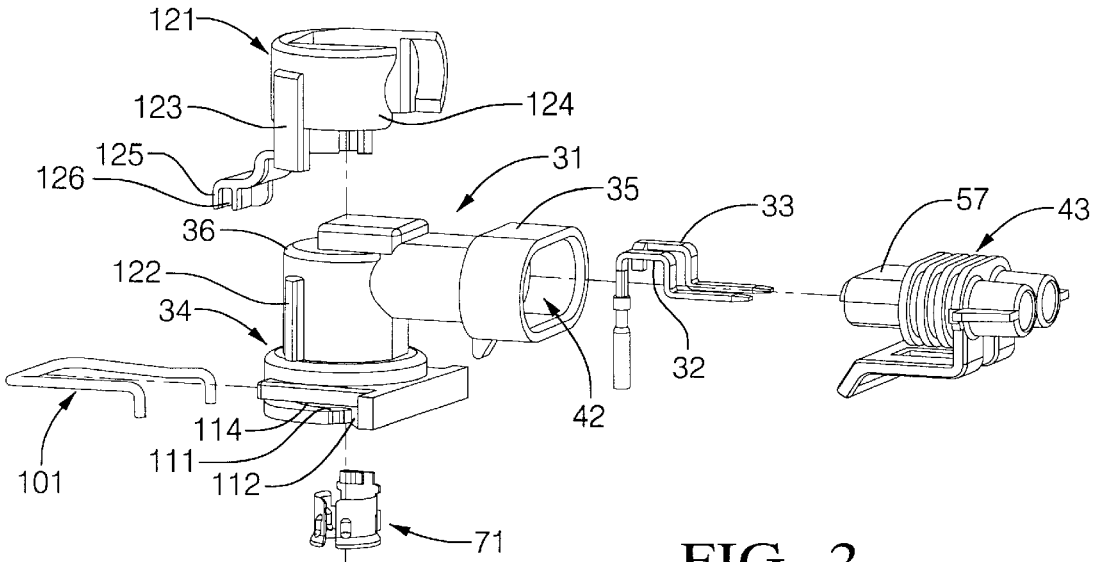
FIG. 2 is an exploded view showing the elements of the electrical connection system of the present invention.

As best seen in FIGS. 2 and 10 wire lock 101 fits in a transverse slot 111 located on the exterior of longitudinal portion 34 of electrical connector 31. In turn, fingers 104 and 105 rest within slot 111, legs 107 and 108 abutting against an angled lock tab 112. Transverse slot 111 is open to interior cavity 37 of connector 31 at slot openings 114 and 115, located on opposite circumferential sides of longitudinal portion 34. Thus, fingers 104 and 105 also extend within interior cavity 37 and constrict the longitudinal opening thereto. After fastener 17 has been placed on piston rod 14, electrical connector 31 is snapped into position on fastener 17. This is done by pushing downward on electrical connector 31. Additional clearance can be gained by pushing wire lock 101 at bridge finger 106 toward the main body of electrical connector 31, forcing legs 107 and 108 to ride down the angled lock tabs 112. Either method causes the spring wire of wire lock 101 to expand. Specifically it causes fingers 104 and 105 to expand radially outwardly from interior cavity 37, allowing transverse slot 111 to pass over chamfered portion 94 of fastener 17 and coming to rest in groove 96. Thereupon, wire lock 101 may be released causing legs 107 and 108 to ride back up angled lock tabs 112 and causing fingers 104 and 105 to spring through transverse slot openings 114 and 115 and into interior cavity 37. It will be appreciated that fingers 104 and 105 need not be in side by side contact with groove portion 96. However, outer radial perimeter 97 forming the edge of chamfered portion 94 and grooved portion 96 prevents wire lock 101 and thus electrical connector 31 from rising back off piston rod 14.

Figure 9:
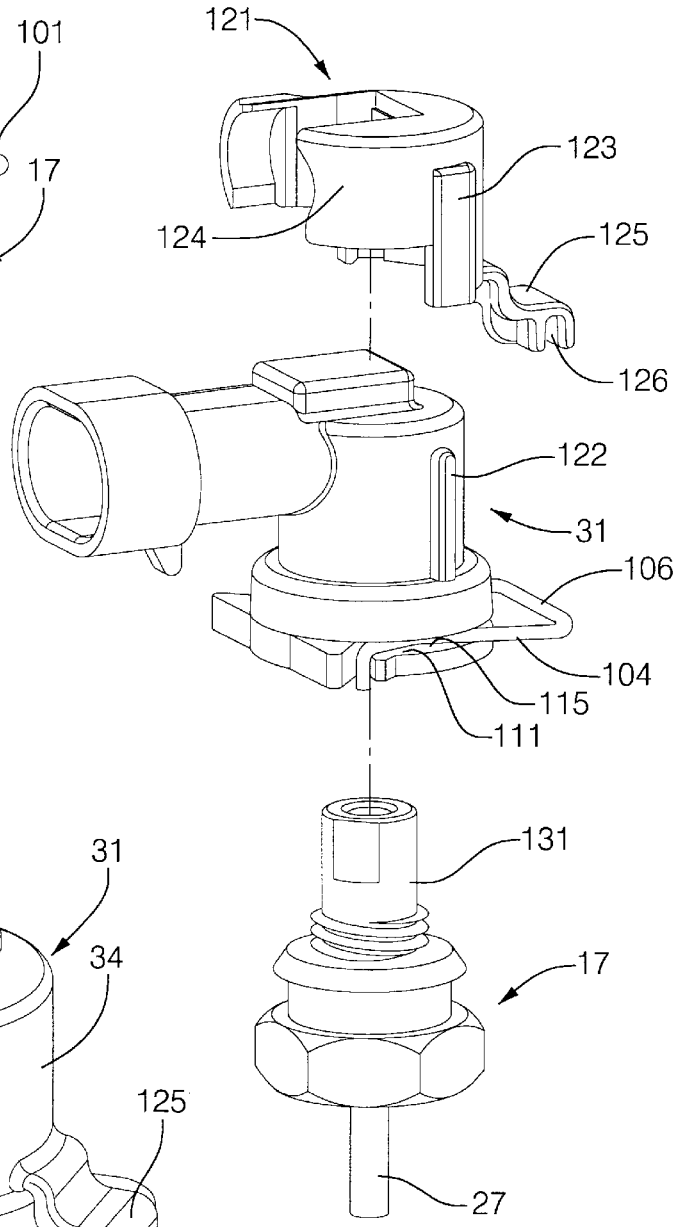
FIG. 9 is a exploded pictorial view showing a partially assembled damper assembly of the present invention.

Connection position assurance is supplied by a position assurance connection member 121. It is molded to fit over the exterior housing of electrical connector 31. Longitudinally extending portion 34, (as seen in FIGS. 2 and 9) has two abutments 122 which are captured in a molded raceway 123 of connection member 121 to provide for proper alignment on connector 31. Extending from a sleeve portion 124 of connection member 121 is an "S" shaped arm 125 having a slot 126 therein. Once connector 31 has been installed on piston rod 14 and wire lock 101 snapped into place over fastener 17, connection member 121 is placed snugly over longitudinal portion 34 of connector 31, slot 126 entrapping bridge finger 106 of wire lock 101. Thereafter, wire lock 101 may not be disengaged accidentally or through vehicle vibration. However, for service purposes connection member 121 may be snapped out of place, thus making wire lock 101 accessible and allowing for the easy removal of electrical connector 31.

Connector 31 is removed from strut 12 by applying force onto wire lock 101 at bridge finger 106 toward the main body of electrical connector 31. This forces legs 107 and 108 to ride down the angled lock tabs 112 and causes wire lock 101 to expand. Specifically it causes fingers 104 and 105 to expand radially outward so that they clear perimeter 97 and allow connector 31 to be removed from piston rod 14.

To provide an environmental barrier to the electrical interfaces, a silicone seal is overmolded inside interior cavity 37 of longitudinally extending portion 34. This overmold has an interference fit with piston rod 14. Preferably rod 14 has a section 131 which is round and smooth to maximize the sealing performance. Prior to overmolding, a plastic washer 132 is inserted just below ground ring 71 to prevent silicone from flowing into those interior portions of interior cavity 37 which house ground ring 71 and terminal assembly 32. Washer 132 sits in an annular slot 133 bored within interior cavity 37. The silicone seal takes the form of an overmold annular connector seal 134 which sits within interior cavity 37 and abuts plastic washer 132. Annular connector seal 134 has three legs 135, 136, and 137 which extend longitudinally from an annular portion 138 and are generally equally spaced about the perimeter of annular portion 138. Legs 135, 136 and 137 touch fastener nut 17 and help reduce the clearance stack up resulting from the tolerance band needed to use fastener 17 and wire lock 101 for mechanical attachment to damper system 10. Legs 135 through 137 also advantageously provide a force to keep connector 31 from vibrating as part of on damper system 10, thus reducing the chance of terminal fretting.

The invention has been described with reference to the preferred embodiments. Obviously modifications and alterations will occur to others upon reading and understanding this specification. For example, as seen in FIG. 6, fastener nut 17 has been modified with a large abutment portion 141 for abutting against a shoulder of piston rod 14. FIG. 8 shows electrical connector of the present invention in a partially assembled state where connection member 121 has not yet been placed thereon. Other position assurance connection members may also be used, including a connection member integral with the connector body and attached thereto with a plastic hinge. As is apparent from this description, the invention also has application where a device of any kind, such as an actuator, requires electrical power. In such an application, the fastener used to mount the device to a support structure is an described herein. The electrical connector of the present invention snaps into place and is locked onto the fastener in the same manner as described herein. It is intended to include all such modifications and alterations in so far as they come within the scope of the appended claims.

Having thus described the invention, it is claimed:

1. A suspension damper system comprising a longitudinally extending cylinder portion, said cylinder portion including both proximal and distal ends, a damper rod carried in said damper and a portion extending from said proximal end, said damper rod including a bore and an electrode disposed within said bore, a fastener for securing said damper rod to a vehicle, said fastener disposed over said damper rod and including a circumferential groove, an electrical connector for supplying electrical power to said electrode, said connector including an electrically conducting terminal having at least a first and a second end, said first end connected to said electrode, said connector including a lock which mates with said groove of said fastener.

2. The damper system of claim 1, including a position assurance connection member removably attached to said electrical connector.

3. The damper system of claim 1, wherein said groove extends about a perimeter of said fastener.

4. The damper system of claim 1, wherein said lock is a spring lock which includes two legs extending thereform.

5. The damper system of claim 4, wherein said two legs cooperate with tabs on said electrical connector to open and close said lock.

6. The damper system of claim 1, wherein said electrical connector has a damper mating end, said damper mating end including an environmental barrier.

7. The damper system of claim 6, wherein said environmental barrier includes a connector seal having at least one leg depending therefrom and in contact with said fastener.

8. The damper system of claim 7, wherein said connector seal has three legs in contact with said fastener.

9. The damper system of claim 7, wherein said barrier includes a washer seated within an interior of said electrical connector.

10. The damper system of claim 9, wherein said connector seal is disposed between said washer and said fastener.

11. The damper system of claim 1, wherein said fastener is a threaded nut engaged with a threaded stud which forms said portion of said rod extending from said distal end.

12. The damper system of claim 11, wherein said groove circumferentially extends about a perimeter of said threaded nut.

13. The damper system of claim 12, wherein said perimeter of said nut includes a tool engaging portion, a grooved portion and a chamfered portion.

14. The damper system of claim 13, wherein said lock includes a spring wire for placement within said groove.

15. The damper system of claim 14, wherein said spring wire includes a transverse plane portion located in a plane transverse to a longitudinal axis of said nut and a longitudinal plane portion located in plane generally parallel to said longitudinal axis.

16. The damper system of claim 15, wherein said transverse plane portion includes a loop of said spring wire, said longitudinal plane portion including a leg extending from opposite ends of said spring wire.

17. The damper system of claim 14, wherein said spring wire is loop shaped and includes two legs extending from opposite ends of said spring wire.

18. The damper system of claim 14, including a position assurance connection member removably attached to said electrical connector and said spring wire.

19. The damper system of claim 18, wherein said position assurance connection member includes an arm which entraps said spring wire and prevents transverse movement thereof.

20. A suspension damper comprising:

a longitudinally extending cylinder portion, said cylinder portion including both proximal and distal ends, a damper rod carried in said damper and a portion extending from said proximal end, said damper rod including a bore and an electrode disposed within said bore;

a fastener for securing said damper rod to a vehicle, said fastener disposed over said damper rod and including a circumferential groove;

an electrical connector including a power terminal having at least a first and a second end for supplying electrical power to said actuator, said electrical connector having a first extending portion and a second extending portion, the second extending portion being connected to the first extending portion by an elbow portion and extending therefrom at an angle, the second extending portion being adapted to receive the harness connection assembly, said electrical connector including a lock which mates with said groove of said fastener.

21. An electrical connection system for connecting an actuator to a source of electricity, comprising:

a fastener for securing said actuator to an actuator support structure, said fastener including a groove therein;

an electrical connector including a power terminal having at least a first and a second end for supplying electrical power to said actuator, said connector including a lock which mates with said groove of said fastener; and a position assurance connection member removably attached to said electrical connector and said lock.

* * * * *